US007395655B2

(12) United States Patent
Poitout

(10) Patent No.: US 7,395,655 B2
(45) Date of Patent: Jul. 8, 2008

(54) REGULATOR FEEDING CONTROL WITH TWO FLOW RATE LAWS

(75) Inventor: Sylvain Poitout, Vincennes (FR)

(73) Assignee: Hispano Suiza, Colombes (FR)

( * ) Notice: Subject to any disclaimer, the term of this patent is extended or adjusted under 35 U.S.C. 154(b) by 418 days.

(21) Appl. No.: 11/196,506

(22) Filed: Aug. 4, 2005

(65) Prior Publication Data

US 2006/0026947 A1 Feb. 9, 2006

(30) Foreign Application Priority Data

Aug. 4, 2004 (FR) ..... 04 08612

(51) Int. Cl.
*F02C 9/28* (2006.01)

(52) U.S. Cl. ..... 60/39.27; 60/39.281

(58) Field of Classification Search ..... 60/39.27, 60/39.281, 734; 251/233, 234
See application file for complete search history.

(56) References Cited

U.S. PATENT DOCUMENTS 2,757,511 A 8/1956 Jagger
2,968,346 A * 1/1961 Porter ..... 137/565.14
3,021,674 A * 2/1962 Zeisloft ..... 60/39.281
4,503,670 A * 3/1985 Francois et al. ..... 60/39.281
5,411,239 A 5/1995 Sorensen

FOREIGN PATENT DOCUMENTS

GB 700776 A 12/1953
GB 853706 11/1960

* cited by examiner

*Primary Examiner*—L. J. Casaregola
(74) *Attorney, Agent, or Firm*—Rothwell, Figg, Ernst & Manbeck, PC

(57) ABSTRACT

Hydromechanical regulator for controlling the flow of fuel injected into a turbomachine by means of a fuel feed unit (10), comprising a tachometric balance (20) having a beam consisting of two arms (24, 26), which beam can move about a pivot pin (22) under the action of at least a first force $F_1$ applied by a drive rod (18) of the fuel feed unit via a first elastic member (28), and a rod (36) associated with a drive piston (38) for applying, via a second elastic member (40), a force $F_4$ opposing the first force $F_1$ to the beam of the balance so as to cause the fuel feed unit to open further during the transition from a first engine acceleration law to a second engine acceleration law.

6 Claims, 5 Drawing Sheets

FIG.3
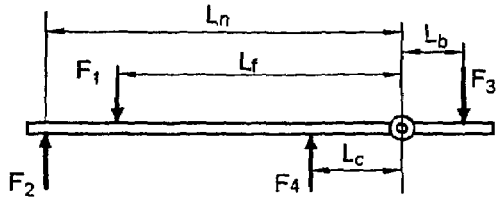
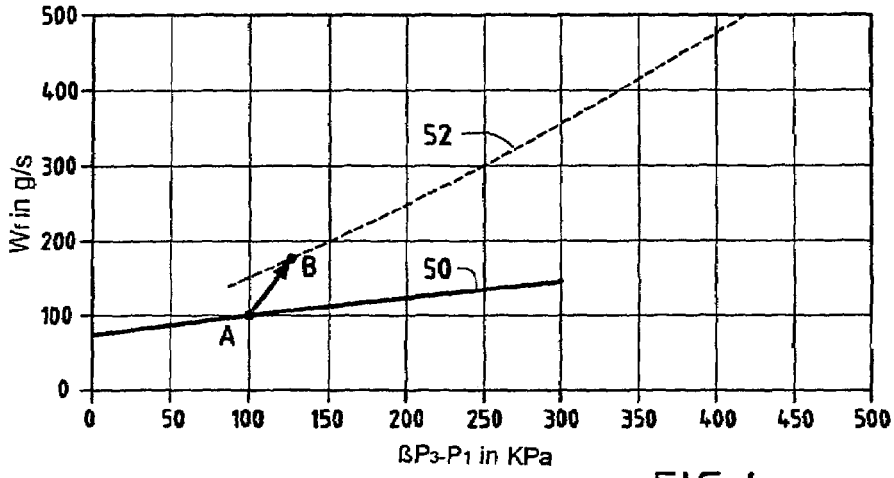
FIG.4
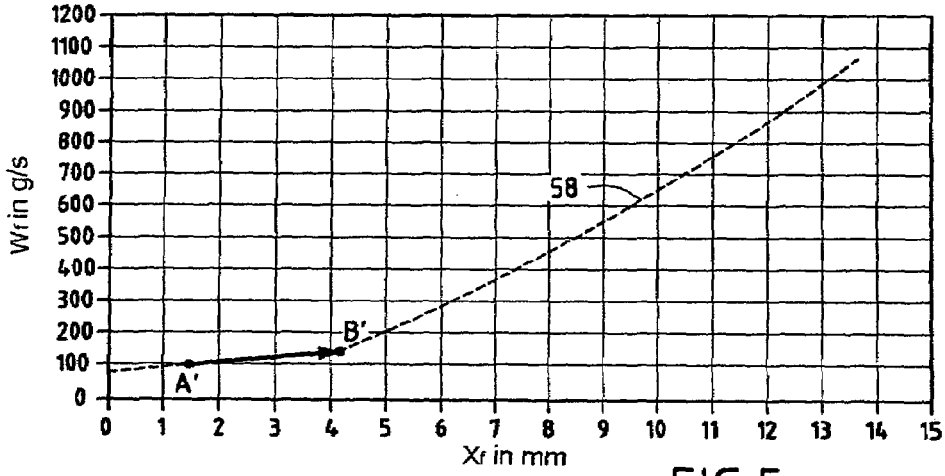
FIG.5

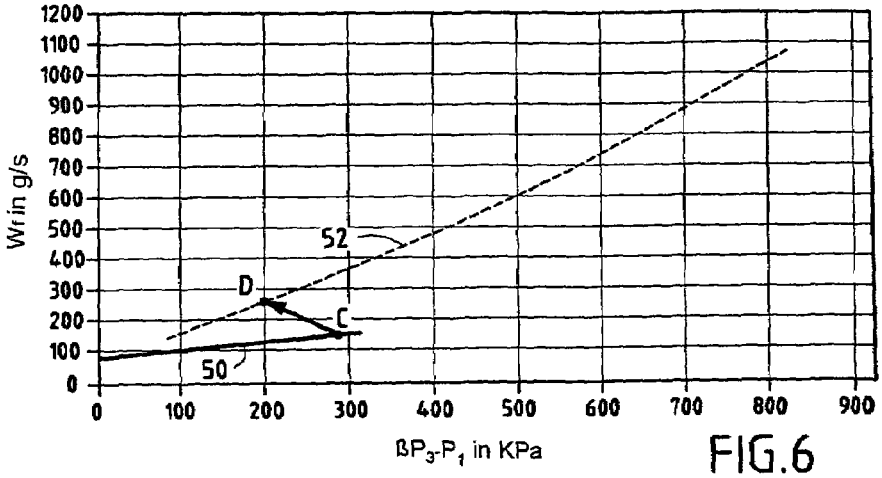
FIG.6
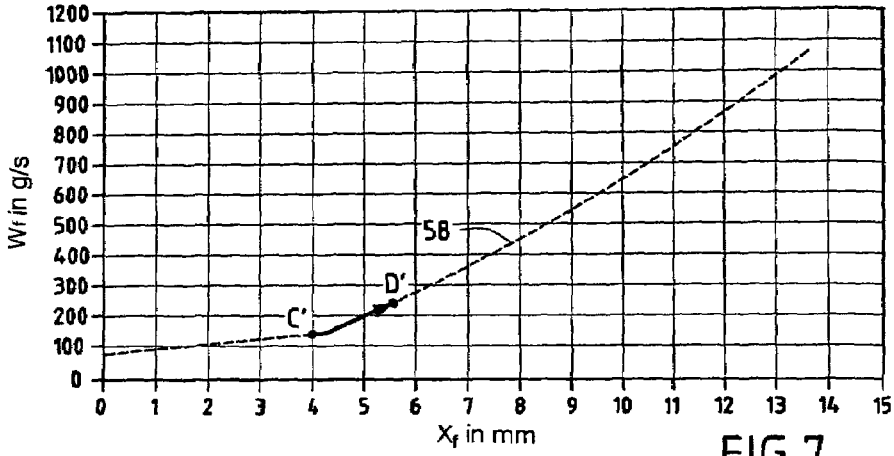
FIG.7
FIG.8
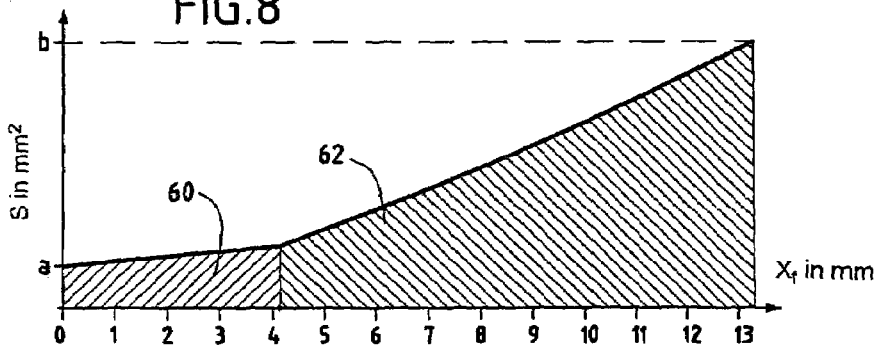

REGULATOR FEEDING CONTROL WITH TWO FLOW RATE LAWS

FIELD OF THE INVENTION

The present invention relates in general to fuel injection systems in turbomachines and more particularly to a hydromechanical regulator of the force-balance type with hydraulic nozzle/flap control.

PRIOR ART

A conventional hydromechanical regulator of the aforementioned type intended for a fuel injection system in a turbomachine is illustrated schematically in FIG. 9. It is organized around a fuel feed unit 10, the inlet duct 12*a* of which is connected to a high-pressure pump 14 and the outlet duct 12*b* is connected to a plurality of fuel injectors for a combustion chamber of the turbomachine 16, the flow of fuel of which, that has to flow into the injectors from the high-pressure pump, is controlled by a force balance (or tachometric balance 20).

The balance, which can move about a pivot pin 22 passing through a sealed partition, conventionally comprises a beam having two arms 24, 26 which, in the steady state, is in balance under the action of the three forces that are applied to it (see FIG. 10). A first force $F_1$ (acting downwards in the figure) is applied, at a distance $L_f$ from the pivot pin, to a fixed point on its first arm 24 by the rod 18 of the fuel feed unit via a first elastic member 28 of the compressed spring type; a second force $F_2$, which opposes the first, is applied by a nozzle 30 which injects, against the first lever arm (forming a flap), at a fixed point a distance $L_n$ from the pivot pin, a pressurized jet of fuel; and a third force $F_3$ (which is also downward in the figure) is applied, at a distance $L_b$ from the pivot pin, at a fixed point on its second arm 26. The latter downward force results from the application of a pressure differential $\beta P_3-P_1$ on an air bellows 32, $P_3$ being the pressure on the output side of the high-pressure compressor (not shown) of the turbomachine, $\beta$ being a multiplicative factor that depends on the operating speed of the turbomachine and is specified by the pilot in order to realize the "acceleration thrust" law that protects the low-pressure compressor (not shown) of the turbomachine from stalling, and $P_1$ being the pressure on the input side of this low-pressure compressor. A valve for protecting the bellows 34 completes the architecture of this regulator, which of course also has inlets and outlets for the high-pressure hydraulic feed HP and the low-pressure hydraulic feed LP.

If the equilibrium of the forces being applied to the beam of the balance 20 is written down, it is found that such a regulator simply controls the opening position of the fuel feed unit as a function of the pressure differential $\beta P_3-P_1$, the position being a linear function thereof. Specifically, it may be shown that this position $X_f$ is given by the following formula:

$$X_f=A(\beta P_3-P_1)+B \quad (1)$$

A and B being constants.

Thus, for a given turbomachine engine acceleration law, which offers the particular feature in the example illustrated of being expressed by a simple geometric equation (for example a linear law 50 or a parabolic law 52) in a graph of the flow rate of injected fuel as a function of $\beta P_3-P_1$, as shown in FIG. 11, and corresponds to a linear feed flow rate law 54 or a parabolic feed flow rate law 56, as shown in FIG. 12.

However, this simplicity of construction of the regulator is only conceivable if there is just one acceleration law. This is because if it is desired to apply two different acceleration laws, such as those shown in FIG. 11, it is quickly apparent that the two curves representing the corresponding feed flow rate law overlap on the x-axis (see FIG. 12), which makes it impossible to produce a single opening for the feed unit and therefore makes it necessary to use two fuel feed units. This results in many drawbacks, both in terms of weight and cost, reliability or precision of the feed.

OBJECTS AND DEFINITION OF THE INVENTION

The object of the present invention is therefore to provide a hydromechanical regulator that alleviates the aforementioned drawbacks and therefore allows there to be two different acceleration laws using just a single fuel feed unit. Another object of the invention is to ensure switching between the two acceleration laws without a risk of fuel overfeed or underfeed.

These objects are achieved by a hydromechanical regulator for controlling the flow of fuel injected into a turbomachine by means of a fuel feed unit, comprising a tachometric balance having a beam consisting of two arms, which beam can move about a pivot pin under the action of at least a first force applied by a drive rod of the fuel feed unit via a first elastic member, characterized in that it furthermore includes a rod associated with a control piston for applying, via a second elastic member, a force opposing the said first force to the said beam of the balance so as to cause the fuel feed unit to open further during the transition from a first engine acceleration law to a second engine acceleration law.

Thus, with this configuration, the transition from one engine acceleration law to the other takes place progressively without any break in flow and by using just a single feed unit.

Preferably, the said first force is applied to a fixed point on the first lever arm at a distance $L_f$ from the said pivot pin and the said opposing force is applied to another fixed point on the said first lever arm at a distance $L_c$ from the said pivot pin.

Advantageously, the said rod of the drive piston is furthermore coupled to an on/off pneumatic valve for switching between the said first engine acceleration law and the said second engine acceleration law and connected, on one side, to a reference pressure $P_0$ and, on the other side, via air orifices $S_0$ and $S_1$, to a pressure $P_3$ on the output side of a high-pressure compressor of the turbomachine.

For a given engine acceleration law, the said pressure $P_0$ corresponds to the pressure on the inlet side of the high-pressure compressor or to atmospheric pressure. Preferably, one of the said air orifices is adjustable in order to allow the said second acceleration law to be regulated.

The invention also relates to the fuel feed unit used in the aforementioned hydromechanical regulator and to a turbomachine that includes this regulator. Thus, the feed unit includes a single feed opening ensuring, for the flow of fuel injected into the turbomachine, a continuous variation upon passing from the first engine acceleration law to the second engine acceleration law.

BRIEF DESCRIPTION OF THE DRAWINGS

The features and advantages of the present invention will become more clearly apparent from the following description, given by way of non-limiting example, in conjunction with the appended drawings in which:

FIG. 3 illustrates the balancing of the forces existing within the regulator of FIGS. 1 and 2;

FIGS. 4 and 6 are plots showing two examples of different engine acceleration laws for two different operating regimes of the turbomachine engine;

FIGS. 5 and 7 are plots showing two examples of laws of variation of the feed unit flow rate for the two engine operating regimes of FIGS. 4 and 6, respectively;

FIG. 8 illustrates the variation in cross section of the feed opening as a function of the position of the metering unit within the regulator of FIGS. 1 and 2;

DETAILED DESCRIPTION OF A PREFERRED EMBODIMENT

Figure 1:
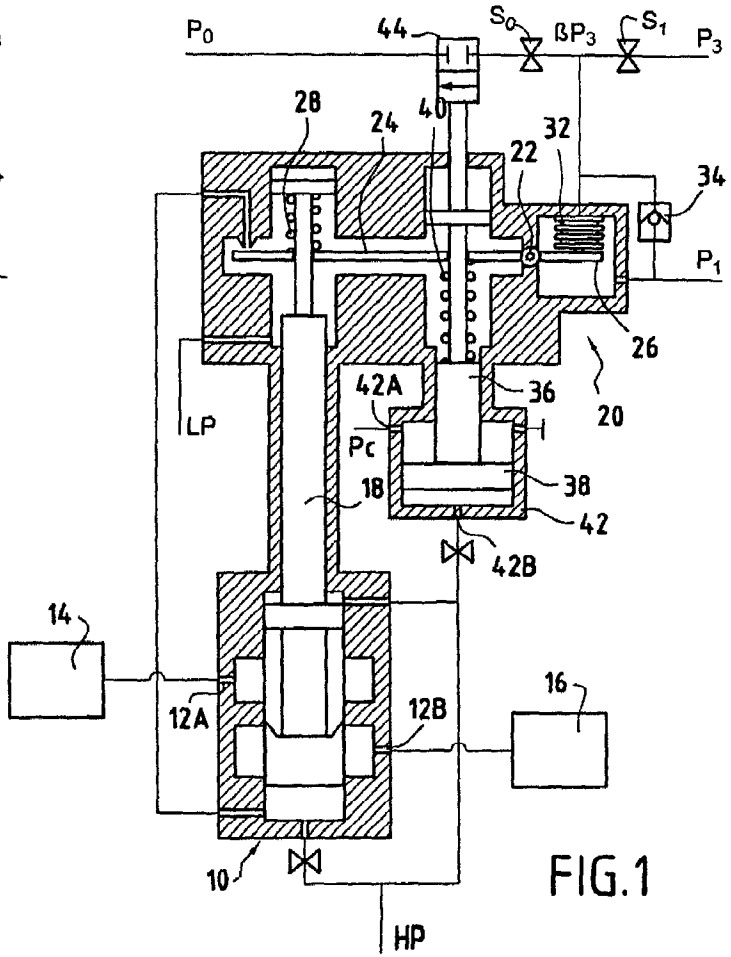
FIG. 1 is a schematic view of a hydromechanical regulator according to the invention in a first position, corresponding to the application of a first engine acceleration law.
Figure 2:
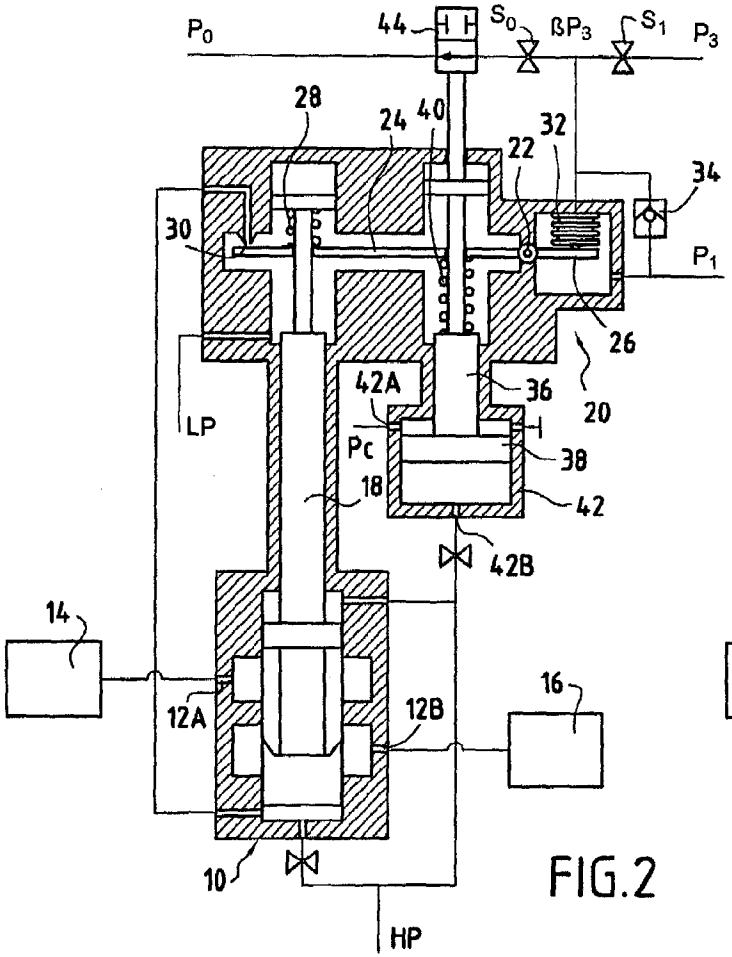
FIG. 2 is a schematic view of a hydromechanical regulator according to the invention in a second position, corresponding to the application of a second engine acceleration law.
Figure 9:
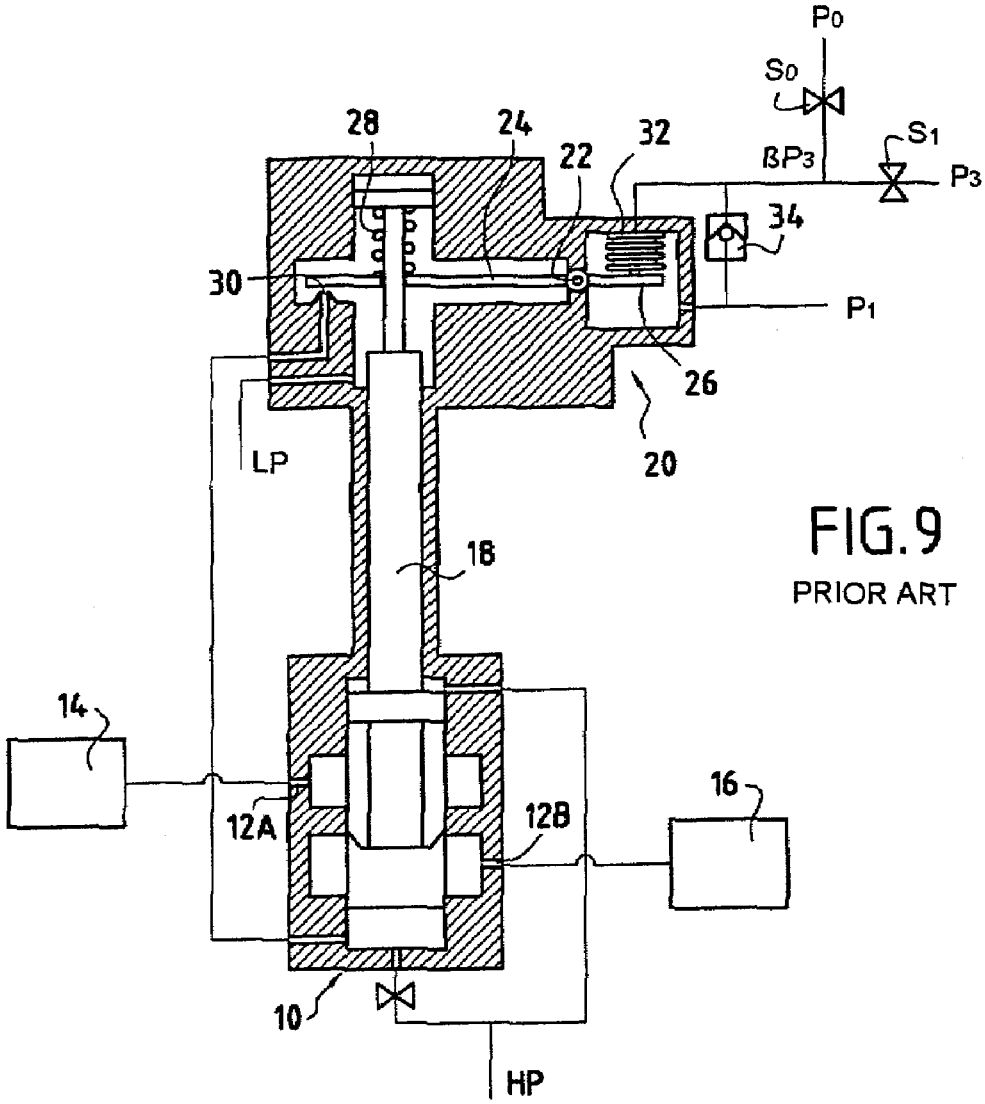
FIG.9 PRIOR ART
FIG. 9 is a schematic view of a hydromechanical regulator of the prior art.
Figure 10:
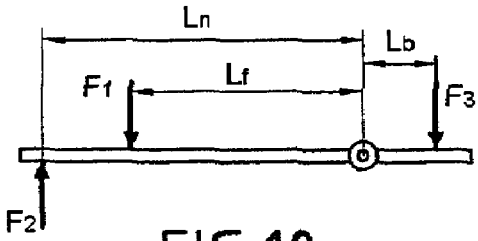
FIG.10 PRIOR ART
FIG. 10 illustrates the balancing of the forces existing within the regulator of FIG. 9.
Figure 11:
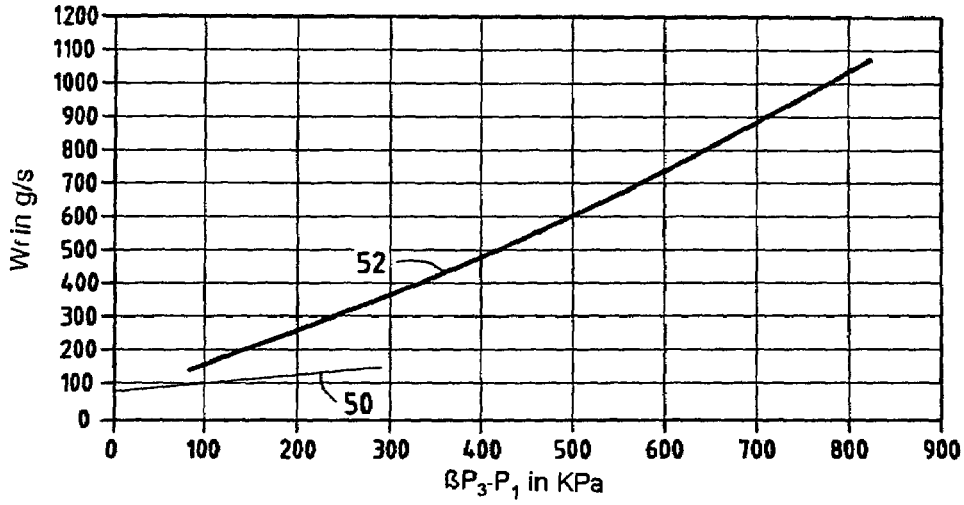
FIG. 11 is a plot showing two examples of engine acceleration laws for two different operating regimes of a turbomachine engine.
Figure 12:
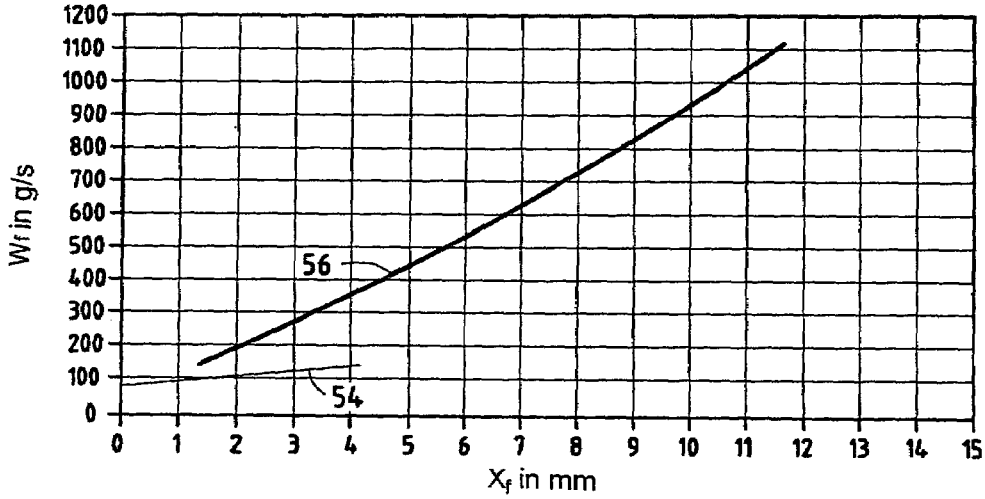
FIG. 12 is a plot showing two examples of feed unit flow rate laws for the two engine operating regimes of FIG. 11.

A hydromechanical regulator according to the invention, intended to be used in a turbomachine, is schematically illustrated in FIGS. 1 and 2. This regulator is intended to regulate the flow of fuel injected into the turbomachine by modifying the cross section of a feed orifice of the fuel feed unit. The aim of this modification is to comply with two operating laws corresponding to the fuel requirement for turbomachine acceleration and to allow switching between these two laws. The first law corresponds to the start-up regime and the second to the operating regime, from idling to full throttle, depending on the rotation speed of the turbomachine and on the position of the control lever.

FIG. 1 illustrates the regulator in a first position corresponding to the operating regime of the turbomachine engine that follows a first acceleration law ($\beta=1$) and FIG. 2 illustrates this same regulator in a second position corresponding to an operating regime of the turbomachine engine that follows a second acceleration law ($\beta=0.5$).

As in the structure of the prior art, there is again a high-pressure fuel pump 14 that withdraws fuel from a fuel tank (not shown) in order to bring it via a fuel feed unit 10 to injectors of a combustion chamber 16 of the turbomachine. The cross section of the feed orifice is modified by displacement of the rod 18 of the feed unit driven through a compressed spring 28 by the force balance 20 which can move about its pivot pin 22 and comprises a beam having two arms 24, 26.

As illustrated in FIG. 3, this beam is subjected to the downward force $F_1$ applied by the rod 18 of the fuel feed unit, via the first elastic member 28, at a fixed point on the first lever arm 24, at a distance $L_f$ from the pivot pin, to the upward force $F_2$ applied by a nozzle 30 that injects a jet of pressurized fuel against this first lever arm, at a fixed point at a distance $L_n$ from the pivot pin, and to the downward force $F_3$ resulting from the application in an air bellows 32 of a pressure differential $\beta P_3-P_1$, at a distance $L_b$ from the pivot pin, at a fixed point on the second arm 26. As previously, a safety valve for protecting the bellows 34 completes the architecture of this regulator, which of course also includes inlets and outlets for the high-pressure and low-pressure hydraulic feeds.

However, according to the invention, the beam of the force balance 20 is also subjected to an additional upward force $F_4$ which is applied to a fixed point on the first lever arm 24 at a distance $L_c$ from the pivot pin (which is less than the distance $L_f$ in the example illustrated) by a rod 36 associated with a control piston 38 via second elastic member 40 of the compressed spring type with a stiffness $K_c$ and a force at rest $F_{c0}$. The piston, which slides in a cylinder 42 over a travel $X_c$, is driven by a control pressure $P_c$ feeding an inlet 42A of this cylinder, an outlet 42B of which is connected to the high-pressure feed HP. The consequence of applying this control pressure, and therefore correspondingly the force $F_4$, to the lever of the balance 20 is to impose an additional displacement (in the direction of opening) of the feed unit 10, the effect of which is to ensure continuity in the flow of fuel injected by the feed unit as a function of its position during the transition from the first acceleration law to the second acceleration law, as will be explained below in conjunction with FIGS. 4 to 8.

Furthermore, the rod 36 is coupled to a pneumatic on/off valve 44 forming a two-position switch. In the "closed" position (as in FIG. 1), the inlet of the air bellows 32 is isolated from a reference pressure $P_0$ and is therefore connected directly to the pressure $P_3$, and in the "open" position (as in FIG. 2), the inlet of the air bellows 32 is connected to this pressure $P_0$ and to the pressure $P_3$ via a pneumatic potentiometer formed from two orifices, an exhaust orifice $S_0$ mounted in the feed line at the pressure $P_0$ and an intake orifice $S_1$ mounted in the feed line at the pressure $P_3$. Since the pressure $P_0$ advantageously corresponds to the pressure on the input side of the high-pressure compressor, or to atmospheric pressure, and since the air orifices $S_0$ and $S_1$ are identical, the ratio $\beta$ has the value 1 and the value 0.5, respectively, corresponding to the two desired acceleration laws. This ratio is constant whenever the flow in the orifice $S_0$ is sonic (which is obtained when $\beta P_3/P_0>1.89$ approximately). Preferably, one of the air orifices (advantageously, the exhaust orifice $S_0$) is adjustable (for example by means of a set screw) for precise regulation of the second acceleration law.

Thus, with this particular architecture, the value of $\beta$ and that of the switching force $F_4$ are controlled by one and the same hydromechanical member, thereby guaranteeing perfect synchronization during the transition from one acceleration law to the other.

As initially, it is possible to determine the new feed unit position $X_f$ from the equilibrium equation of the lever:

$$F_3L_b=F_1L_f-F_2L_n-F_4L_c$$

in which:

$$F_3=S_{bellows}(\beta P_3-P_1)$$

and $$F_1=X_fK_f+F_{f0},$$

$S_{bellows}$ being the cross section of the bellows 32, and $K_f$ and $F_{f0}$ being the stiffness and the force at rest of the spring 28, respectively.

Therefore:

$$X_f=[(S_{bellows}L_b)/(K_fL_f)](\beta P_3-P_1)+(F_2L_n-F_{f0}L_f)/(K_fL_f)+(F_4L_c)/(K_fL_f) \quad (2)$$

i.e., again in relation to equation (1), but without $F_4$:

$$X_f=A(\beta P_3-P_1)+B+\delta X_f,$$

where $\delta X_f=(F_4L_c)/(K_fL_f)$ corresponds to an additional displacement of the feed unit owing to the action of the control force $F_4$.

The operation of the hydromechanical regulator according to the invention will now be explained in conjunction with FIGS. 4 to 8 which illustrate the change in engine acceleration law for two extreme operating points of the engine (the two flight extremes), the first corresponding to a maximum altitude and a minimum Mach number and the second corresponding to a minimum altitude and a maximum Mach number. In these graphs, it may be seen that the feed flow rate $W_f$ changes progressively between the two engine acceleration laws without there ever being an overfeed or an underfeed situation, and therefore that, according to the invention, this regulator allows the engine acceleration law to be changed progressively and continuously using a single feed unit.

FIGS. 4 and 6 each show two curves, one curve 50 corresponding to a linear acceleration law (the transient operating regime between relight and idling) and the other curve 52 corresponding to a parabolic acceleration law (the operating regime between idling and full throttle). These two curves overlap and the maximum flow rate for the first acceleration law is less than the minimum flow rate for the second acceleration law. FIG. 4 is an enlargement of the overlap region of the two acceleration laws shown in FIG. 6. FIGS. 5 and 7 each show the law of variation of the feed f low rate, that is to say the variation of the flow rate $W_f$ of injected fuel as a function of the position $X_f$ of this feed unit. It may be seen that, when, in the transient regime, the engine operating point switches from point A on the first acceleration law to point B on the second acceleration law (FIG. 4), the displacement of the feed unit moves continuously up the feed unit flow rate curve 58 from point A' to point B' (FIG. 5). Likewise, when the engine operating point switches from point C on the first acceleration law to point D on the second acceleration law (FIG. 6), the displacement of the feed unit moves continuously from point C' to point D' (FIG. 7).

The cross section of the single feed slot (or opening) of the feed unit 10 is illustrated in FIG. 8 (for greater clarity, the figure has not been drawn to scale). It has a shape determined by the two aforementioned acceleration laws and varies linearly as a function of $X_f$. The rectangular slot portion 60 corresponds to the linear acceleration law (the transient operating regime between relight and idling) and the triangular slot portion 62 corresponds to the parabolic acceleration law (the operating regime between idling and full throttle), it being possible to adjust the initial flow rates by means of an orifice advantageously placed in parallel with the feed unit.

To conclude, the configuration of the invention is particularly beneficial since, by using a single feed system to provide two flow rate laws, a weight saving and a space saving are achieved. Furthermore, the fact of using only a single independent system, and not two systems, increases the reliability and reduces the number of breakdowns possible. In addition, this single feed system allows switching from one law to the other without any risk of a break in fuel flow during the transition, and therefore there is no engine overspeed or "flame-out" problem.

The invention claimed is:

1. A Hydromechanical regulator for controlling the flow of fuel injected into a turbomachine by means of a fuel feed unit (10), comprising a force balance (20) having a beam consisting of two arms (24, 26), which beam can move about a pivot pin (22) under the action of at least a first force ($F_1$) applied by a drive rod (18) of the fuel feed unit via a first elastic member (28), and a rod (36) associated with a control piston (38) for applying, via a second elastic member (40), a force ($F_4$) opposing the first force to the beam of the balance so as to cause the fuel feed unit to open further during the transition from a first engine operating regime to a second engine operating regime, wherein the rod of the control piston is furthermore coupled to an on/off pneumatic valve (44) for switching between the first engine operating regime and the second engine operating regime and connected, on one side, to a reference pressure $P_0$ and, on the other side, via air orifices $S_0$ and $S_1$, to a pressure $P_3$ on the output side of a high-pressure compressor of the turbomachine.

2. A Hydromechanical regulator according to claim 1, characterized in that the first force is applied to a fixed point on the first lever arm (24) at a distance $L_f$ from the pivot pin and in that the opposing force is applied to another fixed point on the first lever arm (24) at a distance $L_c$ from the pivot pin.

3. A Hydromechanical regulator according to claim 1, characterized in that the pressure $P_0$ corresponds to the pressure on the inlet side of the high-pressure compressor or to atmospheric pressure.

4. A Hydromechanical regulator according to claim 1, characterized in that one of the air orifices is adjustable in order to allow the second engine operating regime to be regulated.

5. A Fuel feed unit in conbination with the hydromechanical regulator of claim 1 for controlling the flow of fuel into a turbomachine, characterized in that the fuel feed unit includes a single feed opening (60, 62) ensuring, for the flow of fuel injected into the turbomachine, a continuous variation upon passing from a first engine operating regime to a second engine operating regime.

6. A Turbomachine, which includes a hydromechanical regulator according to claim 1.

* * * * *